US009309738B2

(12) United States Patent
Brown et al.

(10) Patent No.: US 9,309,738 B2
(45) Date of Patent: Apr. 12, 2016

(54) BREAK-AWAY SUPPORT RING FOR WELLBORE APPARATUS

(71) Applicant: Scientific Drilling International, Inc., Houston, TX (US)

(72) Inventors: Mike Brown, Atascadero, CA (US); Nate Paszek, Atascadero, CA (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 261 days.

(21) Appl. No.: 14/208,979

(22) Filed: Mar. 13, 2014

(65) Prior Publication Data

US 2014/0262273 A1 Sep. 18, 2014

Related U.S. Application Data

(60) Provisional application No. 61/782,906, filed on Mar. 14, 2013.

(51) Int. Cl.

| | |
|---|---|
| ***E21B 31/00*** | (2006.01) |
| ***E21B 17/06*** | (2006.01) |
| ***E21B 29/00*** | (2006.01) |
| *E21B 41/00* | (2006.01) |
| *E21B 31/16* | (2006.01) |

(52) U.S. Cl.

CPC ..... *E21B 31/00* (2013.01); *E21B 17/06* (2013.01); *E21B 29/00* (2013.01); *E21B 31/16* (2013.01); *E21B 41/0021* (2013.01)

(58) Field of Classification Search

CPC ..... E21B 31/00; E21B 29/00; E21B 41/0021; E21B 17/06; E21B 31/16

See application file for complete search history.

(56) References Cited

U.S. PATENT DOCUMENTS

| | | | | |
|---|---|---|---|---|
| 2,277,580 | A * | 3/1942 | Carothers | E21B 29/007 166/55.6 |
| 2,449,841 | A * | 9/1948 | Claypool | E21B 17/06 166/237 |
| 3,005,493 | A * | 10/1961 | Crowe | E21B 29/00 166/214 |
| 3,019,840 | A * | 2/1962 | Kennard | E21B 29/00 166/237 |
| 5,107,939 | A | 4/1992 | Lenhart et al. | |
| 5,127,482 | A * | 7/1992 | Rector, Jr. | E21B 17/06 166/242.8 |
| 7,114,562 | B2 | 10/2006 | Fisseler et al. | |
| 7,878,242 | B2 | 2/2011 | Gray | |
| 7,997,336 | B2 | 8/2011 | Sokol et al. | |
| 8,020,634 | B2 | 9/2011 | Utter et al. | |
| 2015/0226018 | A1 * | 8/2015 | Baudoin | E21B 17/06 166/377 |

OTHER PUBLICATIONS

International Search Report and Written Opinion issued in International Application No. PCT/US2014/025973 dated Jul. 18, 2014 (8 pages).

* cited by examiner

*Primary Examiner* — Shane Bomar
(74) *Attorney, Agent, or Firm* — Adolph Locklar

(57) ABSTRACT

An apparatus and method of use for an apparatus that may include: a) a protuberance slicer and orientation device a cylindrical sleeve, the cylindrical sleeve having a down-hole end with an outer edge perpendicularly affixed to an annular support ring, and an up-hole end having a cut-out mating edge; the annular support ring having an orifice, a protuberance slicer, a plurality of fins, and a diameter that exceeds the diameter of the cylindrical sleeve; and b) a center body device, having a cylindrical sleeve having a pivotable load measurement mechanism disposed thereon, and a cut-out mating mechanism disposed thereon; where the apparatus is positioned atop a subterranean tool string.

20 Claims, 3 Drawing Sheets

BREAK-AWAY SUPPORT RING FOR WELLBORE APPARATUS

CROSS-REFERENCE TO RELATED APPLICATION

The present application is a non-provisional application which claims priority from U.S. provisional application No. 61/782,906 filed Mar. 14, 2013.

FIELD OF THE DISCLOSURE

The present disclosure is in the area of tool support and tool retrieval within a subterranean drill string.

BACKGROUND OF THE DISCLOSURE

In the field of oil and gas exploration and production, difficulties may arise when down-hole equipment becomes stuck in the borehole, thereby resulting in a tension overload when a cable is used to remove the tool from the wellbore. Certain devices are used to prevent damage to down-hole equipment, to retrieve the equipment, and to break the connection between the cable and down-hole equipment if necessary.

SUMMARY

The present disclosure provides for a break away support ring apparatus. The break away support ring apparatus may include a protuberance slicer and orientation device. The protuberance slicer and orientation device may include: an annular support ring, the annular support ring being generally tubular; a protuberance slicer, the protuberance slicer being generally tubular and positioned within the annular support ring; and a cylindrical sleeve, the cylindrical sleeve being generally tubular and having an inner diameter generally the same size as the internal diameter of the protuberance slicer, the cylindrical sleeve having a down-hole end with an outer edge and an up-hole end having a cut-out mating edge, the cylindrical sleeve including a pocket extending radially outward from the inner surface of the cylindrical sleeve. The break away support ring apparatus may also include a center body device. The center body device may include an up-hole end and a down-hole end, the down-hole end coupleable to a probe-based tool. The center body device may include a shear linkage, the shear linkage pivotably coupled to the center body device and positioned to radially outwardly from the center body device in an extended position and to recede into a recess of the center body device in a retracted position, the shear linkage adapted to extend into the pocket of the cylindrical sleeve of the protuberance slicer and orientation device when the center body device is positioned within the protuberance slicer and orientation device; and a cut out mating edge, the cut out mating edge being generally tubular and extending about the center body device, the cut out mating edge including a curved or angled profile positioned to mate with the first cut out mating edge of the protuberance slicer and orientation device when the center body device is positioned within the protuberance slicer and orientation device.

The present disclosure also provides for a method. The method may include positioning a probe based tool within a tubular, the probe based tool coupled to a break away support ring apparatus. The break away support ring apparatus may include a protuberance slicer and orientation device. The protuberance slicer and orientation device may include an annular support ring, the annular support ring being generally tubular; a protuberance slicer, the protuberance slicer being generally tubular and positioned within the annular support ring; and a cylindrical sleeve, the cylindrical sleeve being generally tubular and having an inner diameter generally the same size as the internal diameter of the protuberance slicer, the cylindrical sleeve having a down-hole end with an outer edge and an up-hole end having a cut-out mating edge, the cylindrical sleeve including a pocket extending radially outward from the inner surface of the cylindrical sleeve. The break away support ring apparatus may also include a center body device, the center body device having an up-hole end and a down-hole end, the down-hole end coupleable to the probe-based tool. The center body device may include a shear linkage, the shear linkage pivotably coupled to the center body device and positioned to radially outwardly from the center body device in an extended position and to recede into a recess of the center body device in a retracted position, the shear linkage adapted to extend into the pocket of the cylindrical sleeve of the protuberance slicer and orientation device when the center body device is positioned within the protuberance slicer and orientation device; and a cut out mating edge, the cut out mating edge being generally tubular and extending about the center body device, the cut out mating edge including a curved or angular profile positioned to mate with the first cut out mating edge of the protuberance slicer and orientation device when the center body device is positioned within the protuberance slicer and orientation device. The method may also include applying a force to the center body device in a direction away from the protuberance slicer and orientation device; and retrieving the probe based tool.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
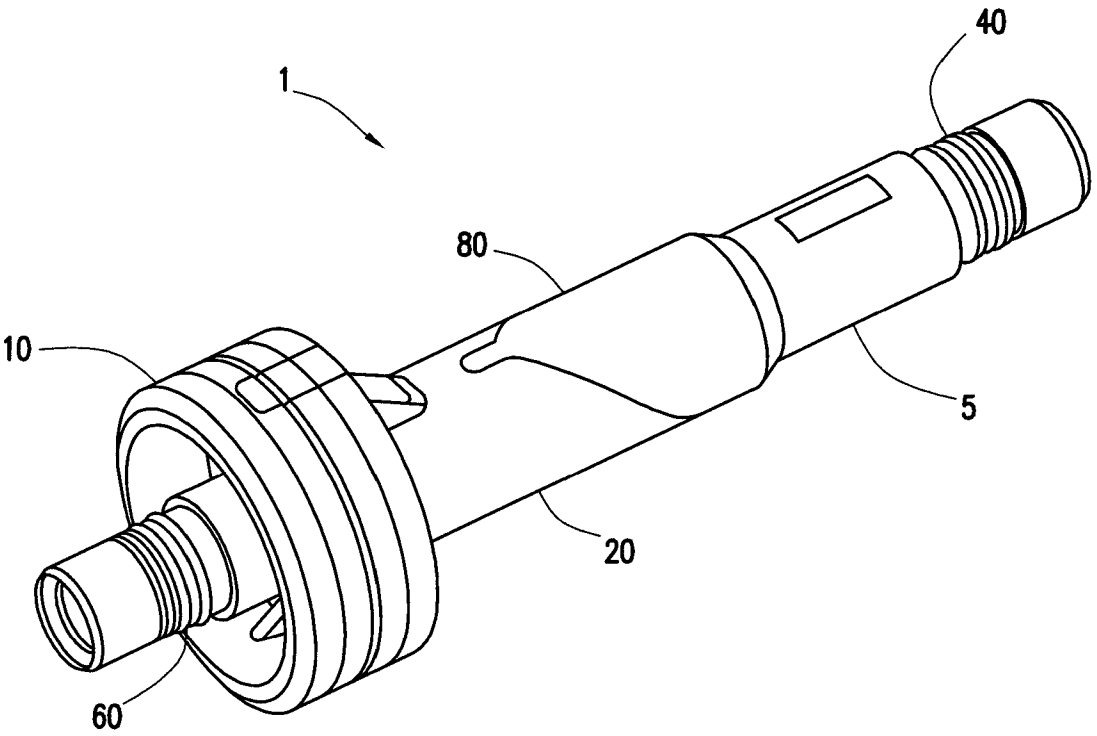
FIG. 1 depicts a fully assembled apparatus that is consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The present disclosure provides an apparatus for support and retrieval of subterranean drilling equipment, such as navigation and telemetry equipment, rotary steerable equipment, measurement while drilling equipment, and logging while drilling equipment. In some embodiments, the disclosed apparatus supports this equipment from the top of the tool while drilling, this may also be referred to as a "top-hung" configuration. Additionally, in case of a torque overload, an embodiment of the disclosure provides means for preferential breaking or shearing of the connection between the retrievable drilling equipment and any large diameter component positioned below the apparatus.

Figure 2A:
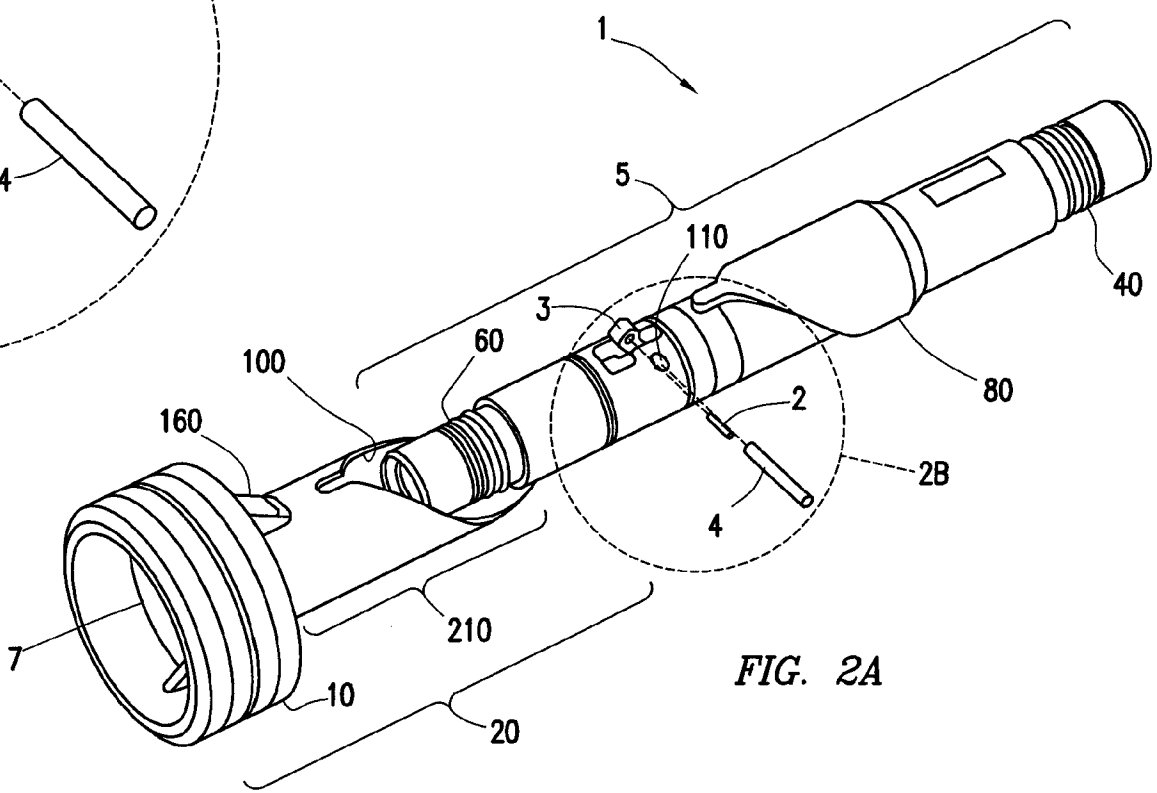
FIGS. 2A, 2B are views of an apparatus detailing the specific parts and features that is consistent with at least one embodiment of the present disclosure.
Figure 2B:
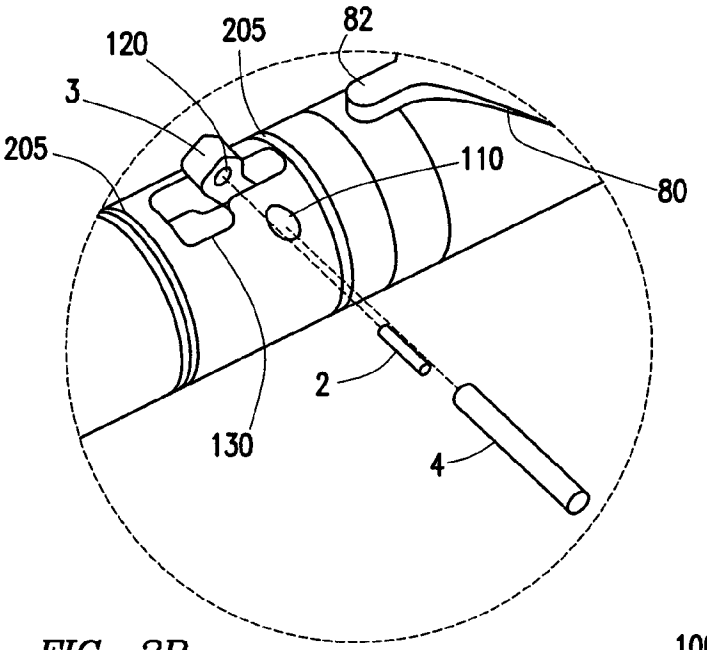
Figure 3:
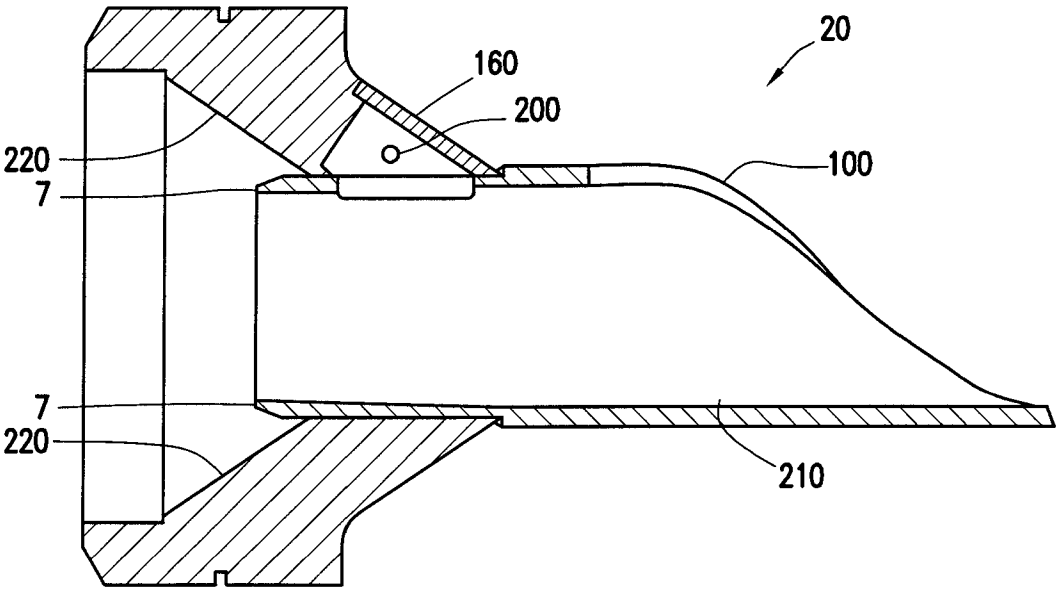
FIG. 3 is a cut-away view of a portion of an apparatus that is consistent with at least one embodiment of the present disclosure.

Referring to FIGS. 2, 3, in some embodiments break away support ring apparatus 1 may include protuberance slicer and orientation device 20 and center body device 5. Protuberance slicer and orientation device 20 may include cylindrical sleeve 210 collinear with and coupled to annular support ring 10. In some embodiments, annular support ring 10 may be adapted to support and/or orient break away support ring apparatus 1 and any downhole or probe based tools coupled thereto within a tubular. In some embodiments, cylindrical sleeve 210 may be positioned such that annular support ring 10 is in the down-hole direction from cylindrical sleeve 210, down-hole direction defined as away from the surface when break away support ring apparatus 1 is positioned within a wellbore. Cylindrical sleeve 210 may include cut-out mating edge 100 in the up-hole direction. Annular support ring 10 may be generally tubular in shape. Annular support ring 10 may include protuberance slicer 7. Protuberance slicer 7 may be generally tubular and spaced apart within annular support ring 10. In some embodiments, a plurality of fins 220 may be positioned to couple protuberance slicer 7 to annular support ring 10. The inner diameter of protuberance slicer 7 may be substantially equal to the inner diameter of cylindrical sleeve 210 and, in some embodiments, the inner diameter of any tubulars positioned in an up-hole direction from break away support ring apparatus 1.

In some embodiments, protuberance slicer and orientation device 20 may include pocket 160. Pocket 160 may be positioned on cylindrical sleeve 210 of protuberance slicer and orientation device 20. Pocket 160 may form an outward extension of the interior of cylindrical sleeve 210. The specific diameters and lengths of annular support ring 10 and cylindrical sleeve 210 may vary, depending upon the required applications.

With reference to FIGS. 2A, 2B, center body device 5 may include a cylindrical sleeve having up-hole threaded coupler 40 and down-hole threaded coupler 60. Up-hole threaded coupler 40 may be positioned to couple center body device 5 to an up-hole support structure or other equipment (not shown). Down-hole threaded coupler 60 may be positioned to couple center body device 5 to a downhole probe-based tool (not shown) positioned within a tubular member. In some embodiments, the downhole tool may include without limitation a downhole navigation system, gyroscopic system, etc. including measurement while drilling (MWD) or logging while drilling (LWD) systems.

Center body device 5 may include shear linkage 3 positioned to pivot from a locking position to a flush position. Shear linkage 3 may be coupled to center body device 5 by pivot pin 4 and may be positioned such that when in the flush position, shear linkage 3 pivots into a recess 130 formed in the body of center body device 5 and generally does not extend farther than the radius of center body device 5. Pivot pin 4 is positioned through axial bore 110 on one side of center body device 5 and extends through the lower axial bore (not shown) of shear linkage 3 and further extends through the axial bore (not shown) of center body device 5 on the side opposite entry axial bore 110. Center body device 5 may also include cut-out mating edge 80. Cut-out mating edge 80 may form a generally tubular extension of the outer surface of center body device 5. Cut-out mating edge 80 may include a curved edge profile positioned to mate with a matching curved edge profile 100 formed on cylindrical sleeve 210 of protuberance slicer and orientation device 20. Cut-out mating edge 80 may be positioned on center body device 5 such that when cut-out mating edge 80 is fully mated with cylindrical sleeve 210, shear linkage 3 is aligned with pocket 160. Shear linkage 3 is thus able to be pivoted into pocket 160 and receive shear pin 2. Shear pin 2 may, as understood in the art, be an elongated frangible member and may be formed as one of a shear pin, shear bolt, wire, or other fastener.

With respect to FIGS. 2A, 2B, and 3, when break away support ring apparatus 1 is generally fully engaged and shear linkage 3 is generally fully extended into pocket 160, shear pin 2 may be positioned through an entry axial bore 200 of recessed pocket 160. Shear pin 2 may extend through upper axial bore 120 of shear linkage 3. FIG. 1 depicts an embodiment of a fully engaged or assembled apparatus.

In some embodiments, one or more seals 205 may be positioned to isolate shear linkage 3 and recessed pocket 160 from any well fluid passing around break away support ring apparatus 1 when in use.

In order to aid clarity, an operation of break away support ring apparatus 1 will now be described. Referring to FIGS. 2A, 2B, annular support ring 10 may be positioned atop a probe-based tool located within a tubular such as, for example and without limitation, a drill string (not shown). When fully assembled, shear linkage 3 pivots on pivot pin 4, and engages within recessed pocket 160. Shear linkage 3 may be held in place by shear pin 2. Shear pin 2 may have a predetermined load limit based on diameter and material of construction. Shear pin 2 may be positioned through entry axial bore 200 of recessed pocket 160, upper axial bore 120 of shear linkage 3, and further extending through an exit axial bore (not shown) of recessed pocket 160.

When load is placed on break away support ring apparatus 1, shear pin 2 is put into shear stress between shear linkage 3 and pocket 160 of protuberance slicer and orientation device 20. If the load is in excess of a predetermined load limit, shear pin 2 will mechanically fail and allow shear linkage 3 to retract from pocket 160 into recess 130. The diameter and construction material of shear pin 2 may determine the load limit of shear pin 2, thereby determining the load at which shear pin 2 will fail and subsequently release center body device 5 from protuberance slicer and orientation device 20. Center body device 5 may then be free to separate from protuberance slicer and orientation device 20 and, for example, may then be retrieved along with the probe based tools attached thereto.

In addition to retaining center body device 5 to protuberance slicer and orientation device 20, shear linkage 3 may also retain the radial relation of center body device 5 to protuberance slicer and orientation device 20. Additionally, the radial orientation may be maintained by the mating curved profiles of cut-out mating edge 80 and curved edge profile 100 of cylindrical sleeve 210. In some embodiments, cut-out mating edge 80 and curved edge profile 100 may be formed as symmetrical helices. In other embodiments, cut-out mating edge and curved edge profile 100 may include one or more protrusions such as tongue 82 and groove 102 as depicted in FIGS. 2A, 2B. One having ordinary skill in the art with the benefit of this disclosure will understand that any profile and protrusion may be used without deviating from the scope of this disclosure.

Referring to FIGS. 2A, 2B, after mechanical failure of shear pin 2, when continued force is applied to the apparatus that tends to separate center body device 5 from protuberance slicer and orientation device 20, other down-hole equipment, such as electrical cables, tubes or hoses supplying fluids or gases used by a down-hole tool, or other mechanical linkages, which are coupled to center body device 5 may be pulled through protuberance slicer 7 of protuberance slicer and orientation device 20. Referring to FIG. 3, protuberance slicer 7 may be adapted to sever and/or remove any protrusions on the down-hole tool which extend farther than the inner diameter of protuberance slicer 7. The inner diameter of protuberance slicer 7 may be selected to be the same or a smaller diameter than any tubular members through which center body device 5 and any down-hole tools may be pulled through when retrieved. Thus, in some embodiments, protuberance slicer 7 may, for example, ensure that retrieved equipment travels without obstruction through any other constrictions above, or up-hole from, break away support ring apparatus 1.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions, and alterations herein without departing from the spirit and scope of the present disclosure.

What is claimed is:

1. A break away support ring apparatus comprising:

a protuberance slicer and orientation device including:

an annular support ring, the annular support ring being generally tubular;

a protuberance slicer, the protuberance slicer being generally tubular and positioned within the annular support ring;

a cylindrical sleeve, the cylindrical sleeve being generally tubular and having an inner diameter generally the same size as the internal diameter of the protuberance slicer, the cylindrical sleeve having a down-hole end with an outer edge and an up-hole end having a cutout mating edge, the cylindrical sleeve including a pocket extending radially outward from the inner surface of the cylindrical sleeve; and a center body device, the center body device having an up-hole end and a downhole end, the down-hole end coupleable to a probe-based tool, the center body device including:

a shear linkage, the shear linkage pivotably coupled to the center body device and positioned radially outwardly from the center body device in an extended position and to recede into a recess of the center body device in a retracted position, the shear linkage adapted to extend into the pocket of the cylindrical sleeve of the protuberance slicer and orientation device when the center body device is positioned within the protuberance slicer and orientation device;

a cut out mating edge, the cut out mating edge being generally tubular and extending about the center body device, the cut out mating edge including a curved or angled profile positioned to mate with the first cut out mating edge of the protuberance slicer and orientation device when the center body device is positioned within the protuberance slicer and orientation device.

2. The apparatus of claim 1, wherein the shear linkage further comprises an upper axial bore and a lower axial bore, the lower axial bore adapted to receive a pivot pin, the pivot pin adapted to pivotably couple the shear linkage to the center body device, the upper axial bore adapted to receive a frangible elongated member, the frangible elongated member adapted to retain the shear linkage within the pocket until the frangible elongated member mechanically fails.

3. The apparatus of claim 2, wherein the upper axial bore of the shear linkage may be threaded or unthreaded.

4. The apparatus of claim 2, wherein the frangible elongated member is selected from the group consisting of shear pins, shear bolts, and fasteners.

5. The apparatus of claim 4, wherein the frangible elongated member is comprised of material selected to fail at a predetermined load limit.

6. The apparatus of claim 4, wherein the frangible elongated member is comprised of a diameter selected to fail at a predetermined load limit.

7. The apparatus of claim 4, wherein the frangible elongated member is comprised of a material and a diameter selected to fail at a predetermined load limit.

8. The apparatus of claim 1, wherein the cut-out mating edge of the center body device and the cut-out mating edge of the protuberance slicer and orientation device are helical.

9. The apparatus of claim 1, wherein the cut-out mating edge of the center body device and the cut-out mating edge of the protuberance slicer and orientation device comprise one or more mating protrusions.

10. The apparatus of claim 1, wherein the cut-out mating edge of the center body device is positioned between the shear linkage and the up-hole end of the center body device.

11. The apparatus of claim 1, wherein the apparatus maintains orientation and position of down-hole drilling equipment upon failure of the frangible elongated member.

12. The apparatus of claim 1, wherein the down-hole end of the center body device is attached to retrievable subterranean drilling equipment.

13. The apparatus of claim 1, wherein the down-hole end of the center body device is attached to navigation and telemetry equipment.

14. The apparatus of claim 1, wherein the down-hole end of the center body device is attached to rotary steerable equipment.

15. The apparatus of claim 1, wherein the down-hole end of the center body device is attached to measurement while drilling equipment.

16. The apparatus of claim 1, wherein the down-hole end of the center body device is attached to logging while drilling equipment.

17. A method, comprising:

positioning a probe based tool within a tubular, the probe based tool coupled to a break away support ring apparatus, the break away support ring apparatus including:

a protuberance sheer and orientation device including:

an annular support ring, the annular support ring being generally tubular;

a protuberance slicer, the protuberance slicer being generally tubular and positioned within the annular support ring;

a cylindrical sleeve, the cylindrical sleeve being generally tubular and having an inner diameter generally the same size as the internal diameter of the protuberance slicer, the cylindrical sleeve having a down-hole end with an outer edge and an up-hole end having a cut-out mating edge, the cylindrical sleeve including a pocket extending radially outward from the inner surface of the cylindrical sleeve; and a center body device, the center body device having an up-hole end and a down-hole end, the down-hole end coupleable to the probe-based tool, the center body device including:

a shear linkage, the shear linkage pivotably coupled to the center body device and positioned radially outwardly from the center body device in an extended position and to recede into a recess of the center body device in a retracted position, the shear linkage adapted to extend into the pocket of the cylindrical sleeve of the protuberance slicer and orientation device when the center body device is positioned within the protuberance slicer and orientation device;

a cut out mating edge, the cut out mating edge being generally tubular and extending about the center body device, the cut out mating edge including a curved or angular profile positioned to mate with the first cut out mating edge of the protuberance slicer and orientation device when the center body device is positioned within the protuberance slicer and orientation device;

applying a force to the center body device in a direction away from the protuberance slicer and orientation device; and retrieving the probe based tool.

18. The method of claim 17, wherein the shear linkage further comprises an upper axial bore and a lower axial bore, the lower axial bore adapted to receive a pivot pin, the pivot pin adapted to pivotably couple the shear linkage to the center body device, the upper axial bore adapted to receive a frangible elongated member, the frangible elongated member adapted to retain the shear linkage within the pocket until the frangible elongated member mechanically fails.

19. The method of claim 18, further comprising:

shearing the frangible elongated member; and separating the protuberance slicer and orientation device and the center body device.

20. The method of claim 19, wherein the probe based tool includes one or more protrusions, the protrusions extending from the probe based tool beyond the diameter of the protuberance slicer, and the method further comprises:

shearing or removing the one or more protrusions from the probe based tool.

* * * * *